US006105472A

United States Patent [19]

Junkers

[11] Patent Number: 6,105,472

[45] Date of Patent: Aug. 22, 2000

[54] FLUID-OPERATED TOOL

[76] Inventor: John K. Junkers, 333 Rte. 17 North, Mahwah, N.J. 07430

[21] Appl. No.: 09/036,848

[22] Filed: Mar. 9, 1998

[51] Int. Cl.[7] ..... B25B 13/00

[52] U.S. Cl. ..... 81/57.39; 81/44; 81/36

[58] Field of Search ..... 81/57.39, 57.44, 81/57.36

[56] References Cited

U.S. PATENT DOCUMENTS 4,916,986 4/1990 Junkers ..... 81/57.39

*Primary Examiner*—David A. Scherbel
*Assistant Examiner*—Sinclair Skinner
*Attorney, Agent, or Firm*—Michael J. Striker

[57] ABSTRACT

A fluid-operated tool has a link provided with an engaging element for engaging and turning a threaded connector and turnable about a pivot axis of the engaging element, a housing, a fluid-operated drive including a cylinder-piston unit with a cylinder formed in the housing, a piston reciprocatingly movable in the cylinder and a piston rod connected with the piston, the piston rod being also connected with the link, so that when the drive is actuated by a pressure fluid the piston rod is displaced and turn the link about the pivot axis, the housing being connected with the link exclusively by the piston rod.

6 Claims, 2 Drawing Sheets

FLUID-OPERATED TOOL

BACKGROUND OF THE INVENTION

The present invention relates to fluid-operated tools for tightening or loosening threaded connectors.

Fluid-operated tools are well known and widely used in industry. When a space to apply the tool is narrow, limited clearance fluid-operated tools are utilized. These tools have links which carry an engaging element engaging with a threaded connector and which are connected with the tool housing to be turned by a drive arranged in the housing. In order to obtain the desired torque accuracy during tightening and loosening, it is important that the housing pivots around an axis of the engaging element or the threaded connector engaged by it. For this purpose, the housing in the known tools is provided with side plates, and the link which usually includes two drive plates and a ratchet pivotable in them, is sandwiched between the side plates. The side plates can be either a part of the housing or can be steadily connected to the housing. In this construction the total thickness of the side plates, the drive plates and the ratchet is quite substantial, and in many applications the space required above a nut threaded on a bolt or a stud is less than this thickness. Therefore, the thusly designed fluid-operated tools cannot enter such spaces and cannot operate in these conditions.

SUMMARY OF THE INVENTION

Accordingly, it is an object of the present invention to provide a fluid-operated tool which avoids the disadvantages of the prior art.

In keeping with these objects and with others which will become apparent hereinafter, one feature of the present invention resides, briefly stated, in a fluid-operated tool which has link means having an engaging element and pivotable above an axis of the engaging element, housing means, fluid-operated drive means including cylinder means formed in the housing and piston means reciprocatable in the cylinder means and having piston rod means connected with the link means, wherein the housing means is connected with the link means only through the piston rod means and is pivotable about the axis of the engaging element.

When the fluid-operated tool is designed in accordance with the present invention, with the housing means connected to the link means exclusively through the piston rod means of the drive, the side plates are dispensed with and thereby the total thickness of the engaging part of the tool including only the link means and the ratchet is substantially smaller, thus allowing introduction of the engaging part of the tool is substantially narrower spaces.

In accordance with another feature of the present invention, the fluid-operated cylinder-piston means include two cylinders, two pistons each reciprocatingly movable in the cylinders and each having a connecting rod connected to the link means so that the connecting rods are connected with the link means at two points radially spaced from the pivot axis of the engaging element and from one another, and the cylinders communicate with one another, to thereby turn the points of connection of the piston rods to the link means around the pivot axis of the engaging element by the same angle. In this construction, in addition to the reduction of the thickness of the engaging part of the tool, a high torque accuracy is provided.

In accordance with still another feature of the present invention, the housing is connected with the link means so that under the action of a reaction force acting on the housing during tightening and/or loosening the threaded connector, the housing or at least a part of it can pivot relative to the link means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
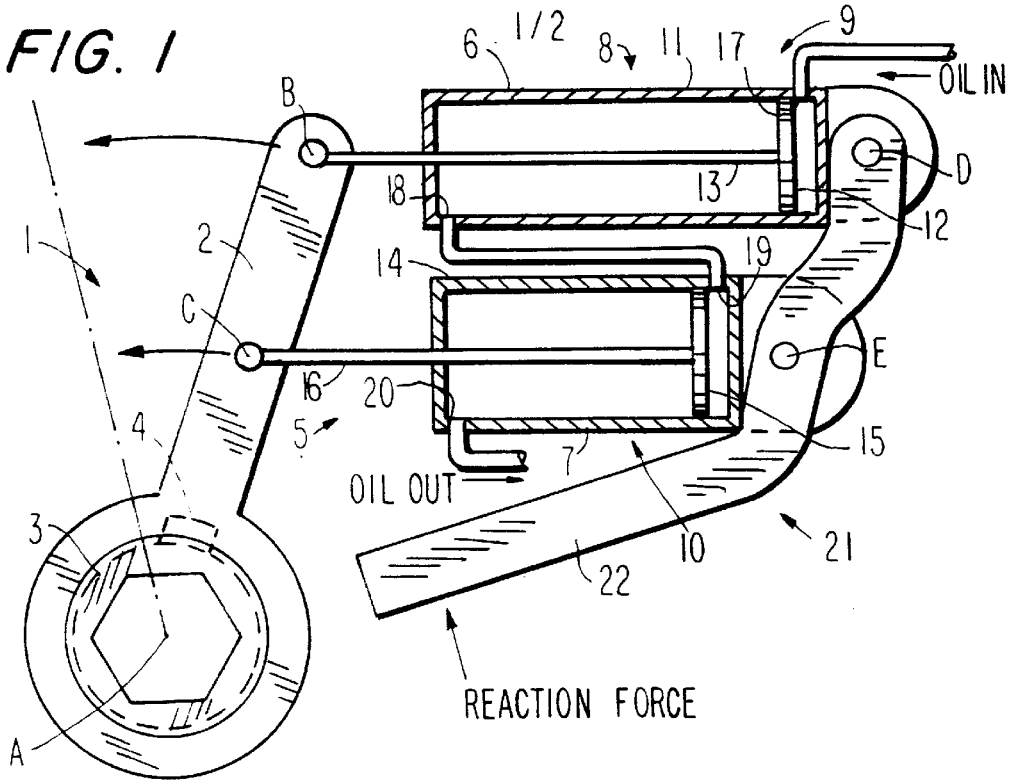
FIG. 1 is a side view schematically showing a fluid-operated tool in accordance with the present invention.

A fluid-operated tool in accordance with the present invention has a link means which is identified as a whole with reference numeral 1. The link means can include two links 2 which are spaced from one another in a transverse direction and have a circular opening, a wratchet 3 turnably received in the openings of the links 2 and having a portion located between the links and provided with a plurality of teeth, and a pawl 4 arranged between the links 2 and having teeth engagable with the teeth of the ratchet. Such a construction is known in the art, as disclosed for example in my U.S. Pat. Nos. 4,368,655 and 4,706,527. The ratchet 3 which forms an engaging element of the tool engages the threaded connector, for example a nut, and not with its inner polygonal opening and is turnable about a pivot axis A so as to turn the nut.

The fluid-operated tool further has a housing which is identified as a whole with reference numeral 5. In the embodiment shown in FIG. 1 the housing has two housing parts 6 and 7. A fluid-operated drive identified as a whole with reference numeral 7 is provided for pivoting the link means 1 about the pivot axis A. The fluid-operated drive 8 in the embodiment shown in FIG. 1 includes two cylinder-piston units 9 and 10. The cylinder-piston unit 9 has a cylinder 11 formed by the housing part 6, a piston 12 reciprocatingly movable in the cylinder 11, and a piston rod 13 connected with the piston 12 and extending outwardly of the cylinder 11. The cylinder-piston unit 10 has a cylinder 14 formed in the housing part 7, a piston 15 reciprocatingly movable in the cylinder 14, and a piston rod 16 connected with the piston 15 and extending outwardly of the cylinder 14. The piston rod 13 of the cylinder-piston unit 9 is pivotably connected with the links 2 in a pivot point B, while the piston rod 16 of the cylinder-piston unit 10 is pivotably connected with the links 2 in the pivot point C. The cylinder 11 of the cylinder-piston unit 9 has a fluid inlet port 17 in the piston chamber and a fluid outlet port 18 in the piston rod chamber, while the cylinder 14 of the cylinder-piston unit 10 has the fluid inlet port 19 in the piston chamber and the fluid outlet port 20 in the piston rod chamber.

Finally, the fluid-operated tool has reaction means which is identified as a whole with reference numeral 21. The reaction means is formed as a reaction plate 22 having one portion formed to abut against a neighboring object, for example a nut, a bolt and the like, and another portion connected to the housing 5. More particularly, the other portion of the reaction plate 22 is connected pivotably to the housing parts 6 and 7 in pivot points D and E, for example by pivot pins extending through openings in the reaction plate 22 and corresponding projections of the housing portions 6 and 7.

In operation, the links 2 are placed with the ratchet 3 so that the polygonal opening of the ratchet 3 is fitted on a threaded connector, for example a nut. A pressure fluid is supplied through the port 17 into the piston chamber of the cylinder-piston unit 9 and displaces the piston 12 together with the piston rod 13 to the left in the drawings, so that the piston rod 13 displace the pivot point B of the link means 1 over an arc to the left as well. The pressure fluid is discharged through the port 18 and supplied through the port 19 into the piston chamber of the cylinder-piston unit 10. The links 2 are pivoted around the pivot axis A so as to turn the pawl 4 which turns the ratchet 3 and as a result turns the nut engaged in the ratchet. Due to the communication of the cylinder-piston units 9 and 10 with one another, and due to the design of their cylinders, chambers, pistons, and piston rods, the pivot points B and C of the lever means 1 are pivoted around the pivot axis A by the same angle, despite the fact that the piston rods 13 and 16 perform the strokes of different lengths. The reaction force which is created during the forward stroke and urges to move the housing portions 6 and 7 in directions opposite to the active stroke of their cylinder-piston units is counteracted by the reaction plate 22 which abuts against a neighboring object, such as for example a neighboring nut or the like. Since during the advanced stroke, the piston rod 13 of the cylinder-piston unit 9 is pushed to the left by the fluid, while the piston rod 16 of the cylinder-piston unit 10 is pulled, reaction forces act in opposite directions. However, in view of the fact that the reaction plate 22 is pivotably connected with the housing 6, 7 or the cylinders 9, 10, the reaction force pushes the cylinder 14 of the cylinder-piston unit 10 toward the front and pushes the cylinder 11 of the cylinder-piston unit 9 toward the rear.

During a reverse stroke, the pressure fluid is supplied in an opposite direction first into the lower cylinder-piston unit 10 and then flows into the upper cylinder-piston unit 9 so as to displace the piston rods 16 and 13 in an opposite direction and therefore to turn the lever means 1 in the opposite direction as well, to turn the threaded connection in an opposite direction.

Figure 2:
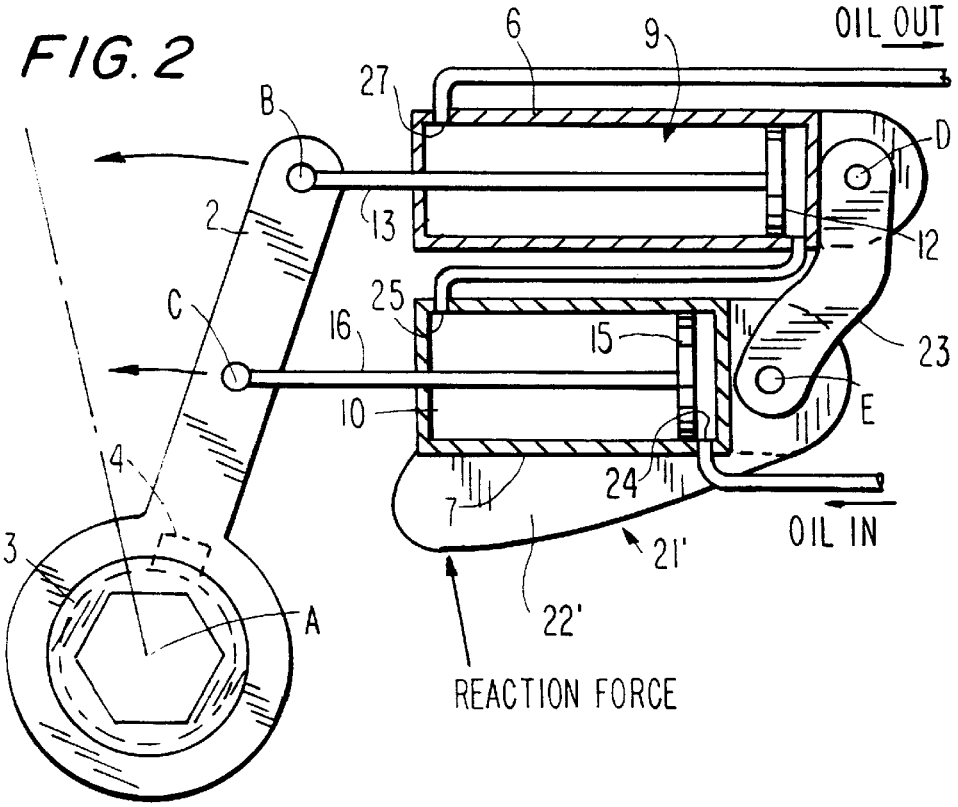
FIG. 2 is a view substantially corresponding to the view of FIG. 1, but showing another embodiment of the inventive fluid-operated tool.

The fluid-operated tool shown in FIG. 2 is substantially similar to the fluid-operated tool shown in FIG. 1. However, in this tool a reaction means 21' is formed as a reaction plate 22' which is fixedly connected to the lower housing portion 7 or the lower cylinder 14. A separate element 23 pivotably connects the housing portion 6, 7 or the cylinders 11, 14 of the cylinder-piston units 9 and 10 with one another. Also here, a fluid inlet port 24 and a fluid outlet port 25 of the cylinder-piston unit 10 are located in the piston chamber and the piston rod chamber correspondingly, while the fluid-inlet port 26 and the fluid outlet port 27 of the cylinder-piston unit 9 are arranged in the piston chamber and the piston rod chamber of the cylinder 11 correspondingly. For the advanced stroke, the fluid is supplied into the cylinder-piston unit 10 to push the piston rod 16, while the piston rod 13 is pulled by the link means 1.

Figure 3:
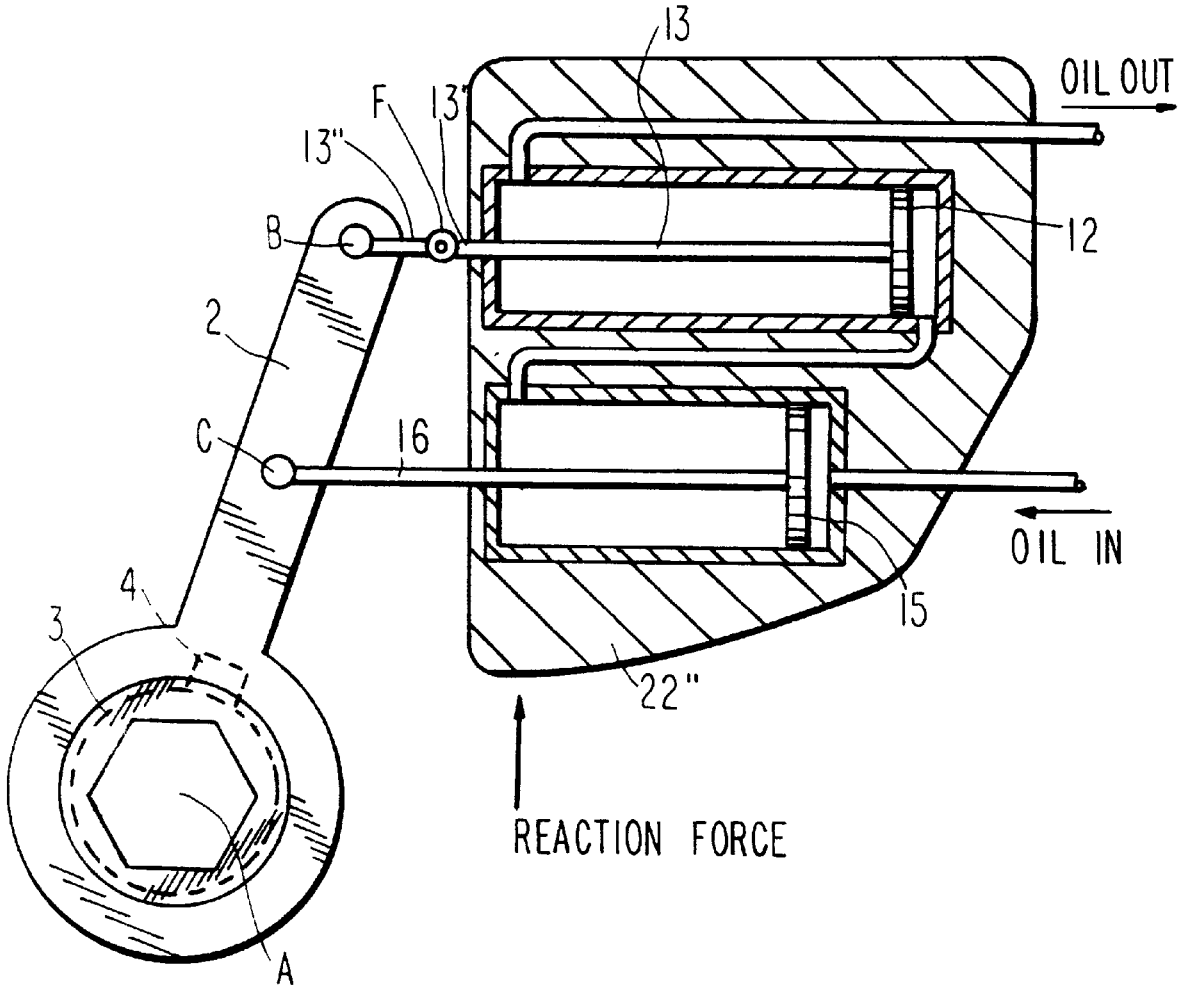
FIG. 3 is a view substantially corresponding to the view of FIG. 1, but showing still a further embodiment of the inventive fluid-operated tool.

The fluid-operated tool of FIG. 3 is substantially analogous to the fluid-operated tool of FIG. 1. However, in this tool a housing 5' is formed as an integral housing, forming both cylinders 11 and 14 of the cylinder-piston units 9 and 10. While the piston rod 16 of the cylinder-piston unit 10 is connected directly to the pivot point C of the lever means 1, the piston rod 13 of the cylinder-piston unit 9 is connected with the pivot point B of the link means 1 pivotably about a pivot point F. In other words, the piston rod 13 has two portions 13' and 13" pivotally connected with one another and also the piston 12 and the link means 1 correspondingly. This allows turning of the housing 5" relative to the link means 1 around the point F in response to different reaction forces acting on the cylinder-piston units and different strokes of the piston rods. In this tool the reaction means 22" is formed by a part of the housing 5".

It will be understood that each of the elements described above, or two or more together, may also find a useful application in other types of constructions differing from the types described above.

While the invention has been illustrated and described as embodied in fluid-operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated tool, comprising link means provided with an engaging element for engaging and turning a threaded connector and turnable about a pivot axis of said engaging element; housing means; fluid-operated drive means including cylinder-piston means with cylinder means formed in said housing means, piston means reciprocatingly movable in said cylinder means and piston rod means connected with said piston means, said piston rod means being also connected with said link means, so that when said drive means is actuated by a pressure fluid said piston rod means is displaced and turn said link means about said pivot axis, said housing means being connected with said link means only by said piston rod means.

2. A fluid-operated tool as defined in claim 1, wherein said cylinder-piston means include two cylinder-piston units, said cylinder means include two cylinders provided in said cylinder-piston units, said piston means including two pistons reciprocatingly movable in said cylinders, and said piston rod means including two piston rods connected with said pistons, said piston rods being also connected with said link means in two pivot points which are radially spaced from said pivot axis and from one another, so that in response to a displacement of said piston rods, said points of said link means are turned around said pivot axis by a same angle.

3. A fluid-operated tool as defined in claim 2; and further comprising means for communicating said cylinders with one another so that said cylinders are in fluid communication with one another and the pressure fluid flow from one of said cylinders to another of said cylinders during actuation of said drive means.

4. A fluid-operated tool as defined in claim 2; and further comprising reaction means for counteracting a reaction force generated during the displacement of said piston rods, said reaction means being pivotably connected with said cylinders.

5. A fluid-operated tool as defined in claim 2, wherein said cylinders of said cylinder-piston units are pivotably connected with one another.

6. A fluid-operated tool as defined in claim 2, wherein at least one of said piston rods has two portions pivotably connected with one another, one of said portions being connected with a corresponding one of said pistons while the other of said portions is pivotally connected with said link means.

* * * * *